United States Patent [19]

Sakshaug et al.

[11] 4,148,135

[45] Apr. 10, 1979

[54] METHOD OF TREATING METAL OXIDE VARISTORS TO REDUCE POWER LOSS

[75] Inventors: Eugene C. Sakshaug, Lanesborough, Mass.; Howard F. Ellis, Stephentown, N.Y.

[73] Assignee: General Electric Company

[21] Appl. No.: 885,294

[22] Filed: Mar. 10, 1978

[51] Int. Cl.[2] ..... H01B 1/08; H01C 1/14

[52] U.S. Cl. ..... 29/621; 338/21

[58] Field of Search ..... 29/610, 613, 619, 620, 29/621, 627; 338/20, 21, 22 R

[56] References Cited

U.S. PATENT DOCUMENTS

| | | | |
|---|---|---|---|
| 3,723,175 | 3/1973 | Masuyama | 29/620 |
| 3,795,048 | 3/1974 | Tachibana | 29/621 |
| 3,857,174 | 12/1974 | May | 29/621 |
| 3,928,245 | 12/1975 | Fishman | 252/521 |
| 4,031,498 | 6/1977 | Hayashi | 29/610 R |

*Primary Examiner*—C. W. Lanham
*Assistant Examiner*—Gene P. Crosby
*Attorney, Agent, or Firm*—Richard A. Menelly; Francis X. Doyle

[57] ABSTRACT

Metal oxide varistors having a uniform wattage gradient across the varistor surfaces are provided by removing a thin layer of metal oxide surface material from the periphery of the varistors prior to applying an insulating collar and a silicone rubber encapsulation for the purpose of heat dissipation.

12 Claims, 4 Drawing Figures

METHOD OF TREATING METAL OXIDE VARISTORS TO REDUCE POWER LOSS

BACKGROUND OF THE INVENTION

Metal oxide varistors of the type consisting of zinc oxide doped with various metal compounds find application as voltage surge protective devices for protecting electrical equipment during overvoltage conditions. The varistor discs are generally provided with metallic electrodes on the large diameter opposing surfaces of the disc and with an insulating collar around the disc periphery. The electrodes provide electrical connection with the zinc oxide material and the insulating collar around the periphery prevents the varistor current from short circuiting across the edges of the disc. The discs are usually encapsulated in a silicone rubber compound to aid in dissipation of heat from the discs resulting from the absorption of surge energy.

During the varistor manufacture, care is taken to ensure that the chemistry of the zinc oxide material is as uniform as possible throughout the entire disc structure. This is done to provide reasonably uniform current flow and low power loss through the cross section of the disc, and to provide uniform properties among individual varistors made from the same batch of zinc oxide material.

Varistors discs, after pressing and sintering, are lapped to make the large diameter surfaces flat and parallel to each other. The discs are then etched in a nitric acid solution to provide surfaces suitable for the attachment of metallic electrodes. After the electrodes are attached, a ceramic insulating collar is applied. A silicone rubber compound is usually applied over the ceramic insulating collar for heat dissipation purposes. The use of the heat dissipation material is fully described in U.S. patent applications Ser. No. 778,006 and Ser. No. 778,007, now U.S. Pat. Nos. 4,092,694 and 4,100,588, respectively.

It has been discovered that the chemical and electrical properties of the outer surfaces of the discs are different from the bulk properties of the discs. This appears to result from the disc surfaces being directly exposed to the atmosphere during the pressing and sintering operations; furthermore, surface contamination can occur during the chemical etching process used prior to application of the electrodes and insulating collar. It has been found as a result of the difference in surface properties when the silicone rubber heat dissipation material is applied, that the watts loss of the varistor under applied AC voltage stress may increase considerably over the watts loss measured at the same stress before the heat dissipation material is applied.

One purpose of this invention is to treat the zinc oxide disc prior to depositing the insulating collar in order to allow the heat dissipation material to be applied without an increase in watts loss.

SUMMARY OF THE INVENTION

The invention comprises a method for removing a small portion of the varistor material from the varistor surface prior to applying the insulating collar material. In one embodiment of the invention, a portion of the varistor surface material is removed by abrading the surface by means of a high velocity air stream containing particles of alumina. Other methods include centerless grinding of the disc surface or other means of physical abrasion.

DESCRIPTION OF THE PREFERRED EMBODIMENT

Figure 1:
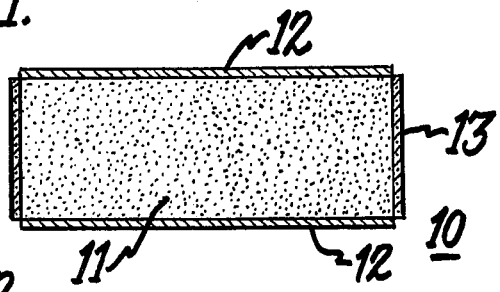
FIG. 1 is a side sectional view of a zinc oxide varistor of the type manufactured according to the invention.
Figure 2:
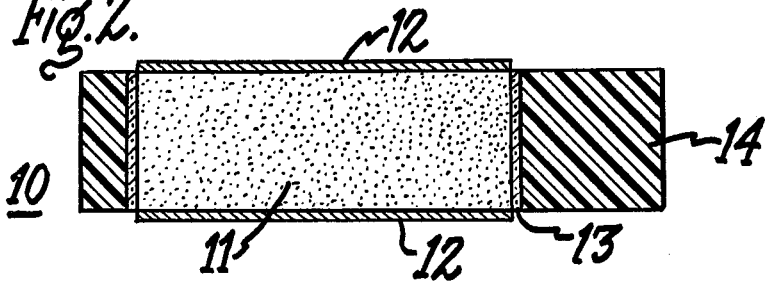
FIG. 2 is a side sectional view of a zinc oxide varistor encapsulated within a rubber compound for heat dissipation purposes.
Figure 3:
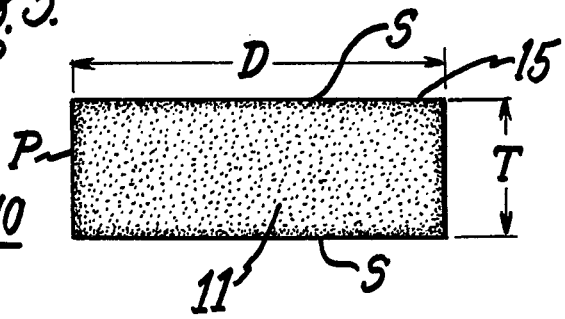
FIG. 3 is a side sectional view of a standard zinc oxide disc immediately after sintering.

FIG. 1 shows a zinc oxide varistor containing a disc of zinc oxide material 11 and an electrode layer 12 on both faces of the disc with an insulating collar 13 around the periphery. Methods and materials for manufacturing zinc oxide varistors are described in U.S. Pat. No. 3,928,245 which is incorporated herein by way of reference. The insulating collar 13 generally consists of a ceramic material and is located around the periphery of the varistor 10 in order to prevent direct arcing between the electrode layers 12. Since heat is generated within the varistor when used in a lightning arrester application and connected between line and ground without an intervening sparkgap, some means is generally employed to remove the heat so that the varistor material does not become overheated. One effective heat dissipation arrangement is to encapsulate the varistor within a silicone rubber compound as described earier. FIG. 2 shows a zinc oxide varistor 10 encapsulated within silicon rubber compound 14 for heat dissipation purposes. FIG. 3 shows a currently manufactured zinc oxide varistor 10 in which the zinc oxide material 11 is shown as a plurality of dots for emphasis. The surface material 15 is shown with a heavier concentration of dots to indicate that the chemical composition of the zinc oxide material along the perimeter P differs substantially from the zinc oxide material 11 within the bulk of the varistor 10. Varistor 10 is generally processed in the form of a flat cylinder of diameter D of approximately 3 inches and a thickness T of approximately $\frac{7}{8}$ inches. The material 15 of surface S is removed during the lapping operation required to make the surfaces flat and parallel.

Figure 4:
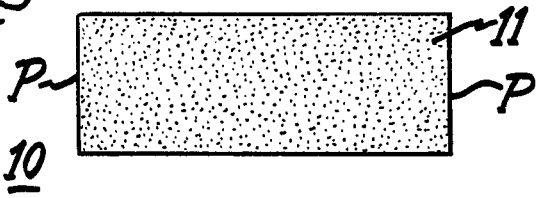
FIG. 4 is a side sectional view of a zinc oxide varistor disc after treating according to the invention.

FIG. 4 shows a zinc oxide varistor 10 after grit blasting with an air pressured stream of aluminum oxide grit applied to the perimeter P for removing from 2 to 4 thousandths of an inch of the surface material 15 from the varistor 10 of FIG. 3.

Subsequent to removing the surface material 15 from the perimeter P of the varistors 10 a porous ceramic collar 13 as shown in FIG. 1 is applied by standard collaring procedures.

The effect of removing the zinc oxide surface in the watts loss of the disc after application of the room temperature vulcanized (R.T.V) silicone rubber heat dissipation material can be seen by referring to the following Tables I and II.

TABLE I

| Collared Without Grit Blasting | | |
|---|---|---|
| Watts Loss Before Application of RTV Heat Dissipation Material | Watts Loss After Application of RTV Heat Dissipation Material | Per Cent Change |
| (Average for Lot) 0.398 Watts | (Average for Lot) 0.569 Watts | 43 |

TABLE II

| Collared After Grit Blasting | | |
|---|---|---|
| Watts Loss Before Application of RTV Heat Dissipation Material | Watts Loss After Application of RTV Heat Dissipation Material | Per Cent Change |
| (Average for Lot) 0.328 | (Average for Lot) 0.3017 | −9 |

Table I shows the watts loss value as measured for a batch of varistors having collars applied without grit blasting and before the application of the RTV silicon material described in the aforementioned U.S. patent applications. The watts loss value for the same group of varistors after application of RTV is also shown for comparison purposes.

The percent increase in watts loss after the application of the RTV material is shown to be as much as 43%.

Table II shows the watts loss value as measured for a separate group of varistors before the application of RTV material. The collars for these varistors were applied after removing the zinc oxide material from the surface by grit blasting techniques. The watts loss value for the same group of varistors after the application of RTV material is also shown for comparison. It is to be noted that the percentage change in watts loss after the application of RTV material to the group of varistors having the zinc oxide material removed by grit blasting prior to collaring experiences a 9% decrease in watts loss. Comparing the group of untreated varistors in Table I, before the application of RTV, to the treated varistors in Table II also before the application of RTV indicates that surface treatment per se causes the watts loss to decrease but to a lesser extent than subsequent to the application of the RTV encapsulant.

Although the invention is directed to surface treating zinc oxide varistors for lightning arrester application this is by of way of example only. The surface treatment of zinc oxide varistors finds application wherever low watts loss varistors are to be employed.

We claim:

1. A method of treating zinc oxide varistors to reduce watts loss, said varistors being of the type consisting of a disc having a pair of metal electrodes on opposing disc surfaces and a collar of insulating material on the surface of the disc periphery comprising the steps of:

removing a layer of zinc oxide material from the periphery of the disc, and then applying the insulating collar.

2. The method of claim 1 wherein the step of removing the zinc oxide material comprises mechanical grinding.

3. The method of claim 1 including the step of removing a layer of zinc oxide material from the opposing disc surfaces prior to applying the metal electrodes.

4. The method of claim 1 wherein the step of removing the zinc oxide material comprises the application of an abrasive material to the surface of the periphery.

5. The method of claim 4 wherein the method of applying the abrasive material comprises grit blasting.

6. The method of claim 1 wherein the surface material is removed to a depth of at least 0.002 inches.

7. The method of claim 6 wherein the surface material is removed to a depth of from 0.002 to 0.004 inches.

8. The method of claim 1 further including the step of applying the insulating collar from a ceramic composition.

9. The method of claim 8 further including the step of encapsulating at least one of the discs in a silicone rubber composition.

10. A method of manufacturing low loss zinc oxide varistors discs comprising the steps of:

providing a plurality of sintered zinc oxide varistor discs having a pair of opposing surface faces and a perimeter;

applying metal electrodes to the two opposing faces for electrical connection with the zinc oxide;

mechanically abrading the perimeter of the discs to remove a surface layer of the zinc oxide; and applying a layer of ceramic material to the abraded perimeter to form an insulating collar.

11. The method of claim 10 wherein the step of mechanical abrasion comprises:

grit blasting the disc perimeter to remove a layer of zinc oxide from the perimeter.

12. The method of claim 11 wherein the zinc oxide is removed to a depth of from 0.002 to 0.004 inches.

* * * * *